US007756452B2

(12) United States Patent
Maeshima et al.

(10) Patent No.: US 7,756,452 B2
(45) Date of Patent: Jul. 13, 2010

(54) DEVELOPING DEVICE WITH STRUCTURE CONFIGURED TO REGULATE DISTANCE BETWEEN DEVELOPING ROLLER AND REGULATING MEMBER FOR DEVELOPER LAYER AND IMAGE FORMING APPARATUS WITH THE DEVELOPING DEVICE

(75) Inventors: Masanobu Maeshima, Osaka (JP); Hisashi Mukataka, Osaka (JP); Yoshihiro Yamagishi, Osaka (JP)

(73) Assignee: Kyocera Mita Corporation (JP)

( * ) Notice: Subject to any disclaimer, the term of this patent is extended or adjusted under 35 U.S.C. 154(b) by 595 days.

(21) Appl. No.: 11/789,818

(22) Filed: Apr. 26, 2007

(65) Prior Publication Data

US 2007/0253749 A1 Nov. 1, 2007

(30) Foreign Application Priority Data

Apr. 28, 2006 (JP) ..... 2006-126630

(51) Int. Cl.
*G03G 15/08* (2006.01)

(52) U.S. Cl. ..... 399/284; 399/274

(58) Field of Classification Search ..... 399/119, 399/273, 274, 279, 283, 284
See application file for complete search history.

(56) References Cited

U.S. PATENT DOCUMENTS 5,128,716 A * 7/1992 Kita ..... 399/126
5,499,082 A * 3/1996 Watanabe et al. ..... 399/274

FOREIGN PATENT DOCUMENTS

JP 56004168 A * 1/1981
JP 5-88527 4/1993
JP 09179389 A * 7/1997
JP 2003149936 A * 5/2003
JP 2003270932 A * 9/2003
JP 2005164737 A * 6/2005

* cited by examiner

*Primary Examiner*—Robert Beatty
(74) *Attorney, Agent, or Firm*—Gerald E. Hespos; Michael J. Porco

(57) ABSTRACT

A developing device supplies developer to an electrostatic latent image bearing body of an image forming apparatus. The developing device includes a container housing with an opening in a position opposite to the electrostatic latent image bearing body and stores developer to be supplied to the electrostatic latent image bearing body. A developing roller is rotatably disposed so that a part of the developing roller is exposed from the opening. A regulator is disposed along an axial direction of the developing roller and has a leading end facing the developing roller to regulate the thickness of developer layer on the developing roller. Two holders support the developing roller and the regulator on the container housing. Each holder includes a developing roller support for supporting an end part of the developing roller and a regulator retainer for retaining the regulator on the container housing.

16 Claims, 4 Drawing Sheets

DEVELOPING DEVICE WITH STRUCTURE CONFIGURED TO REGULATE DISTANCE BETWEEN DEVELOPING ROLLER AND REGULATING MEMBER FOR DEVELOPER LAYER AND IMAGE FORMING APPARATUS WITH THE DEVELOPING DEVICE

BACKGROUND OF THE INVENTION

1. Field of the Invention

The present invention relates to a developing device, particularly, a developing device which supplies developer to an electrostatic latent image bearing body of an image forming apparatus.

2. Description of the Related Art

In a developing device which supplies toner particles to an electrostatic latent image bearing body of an image forming apparatus, an opening is provided in a position opposite to the electrostatic latent image bearing body. From this opening, a developing roller is exposed. In this type of image forming apparatus, a regulating member is provided in a state of facing the developing roller, which regulates the thickness of a toner layer on the developing roller. In such a developing device, toner particles are supplied onto the developing roller. As the developing roller rotates, the developing roller and the regulating member can regulate the toner-layer thickness on the developing roller. Herein, the positional relation between the developing roller and the regulating member determines the toner layer thickness. This requires precise arrangement of the developing roller and the regulating member with respect to each other.

Therefore, a developing device has been worked out which is capable of positioning such a developing roller and a regulating member with precision (refer to Japanese Patent Laid-Open Publication No. 5-88527). In this developing device, in order to accurately arrange the developing roller and the regulating member, the developing roller and a plate member are attached to an attachment member to be attached to a developing unit. To this plate member, the regulating member is fixedly attached.

However, in the developing device according to this patent document, because the regulating member is fixedly attached to the plate member, the tolerance which must be considered for production between the regulating member and the developing roller has three tolerances, that is, a tolerance between the regulating member and the plate member, a tolerance between the plate member and the attachment member, and a tolerance between the developing roller and the attachment member. Hence, deviations in the three tolerances are accumulated, thus making it difficult to precisely arrange the regulating member with respect to the developing roller. This is likely to hinder the regulating member from running parallel to the developing roller, or to cause their respective axes to shift from each other (i.e., twisted relation) even if they are parallel. In such a case, a uniform toner layer cannot be formed on the developing roller.

SUMMARY OF THE INVENTION

It is an object of the present invention to provide a developing device which can precisely arrange a regulating member with respect to a developing roller, and an image forming apparatus provided with the same.

In order to attain this object, a developing device according to an aspect of the present invention, comprises: a container housing having an opening in a position opposite to an electrostatic latent image bearing body for storing developer to be supplied to the electrostatic latent image bearing body; a developing roller which is rotatably disposed and a part of which is exposed from the opening; a regulating member which is disposed along an axial direction of the developing roller and whose leading end is in a position of facing the developing roller, and regulates the thickness of a developer layer on the developing roller; and a pair of holding members which hold the developing roller and the regulating member to the container housing, each holding member including a developing roller support portion for supporting an end part of the developing roller and a regulating member retaining portion for retaining the regulating member to the container housing.

In addition, an image forming apparatus according to another aspect of the present invention, comprises: an electrostatic latent image bearing body; and a developing device which supplies developer to the electrostatic latent image bearing body. The developing device includes the above described configuration.

DETAILED DESCRIPTION OF THE PREFERRED EMBODIMENTS

1. Whole Configuration

Figure 1:
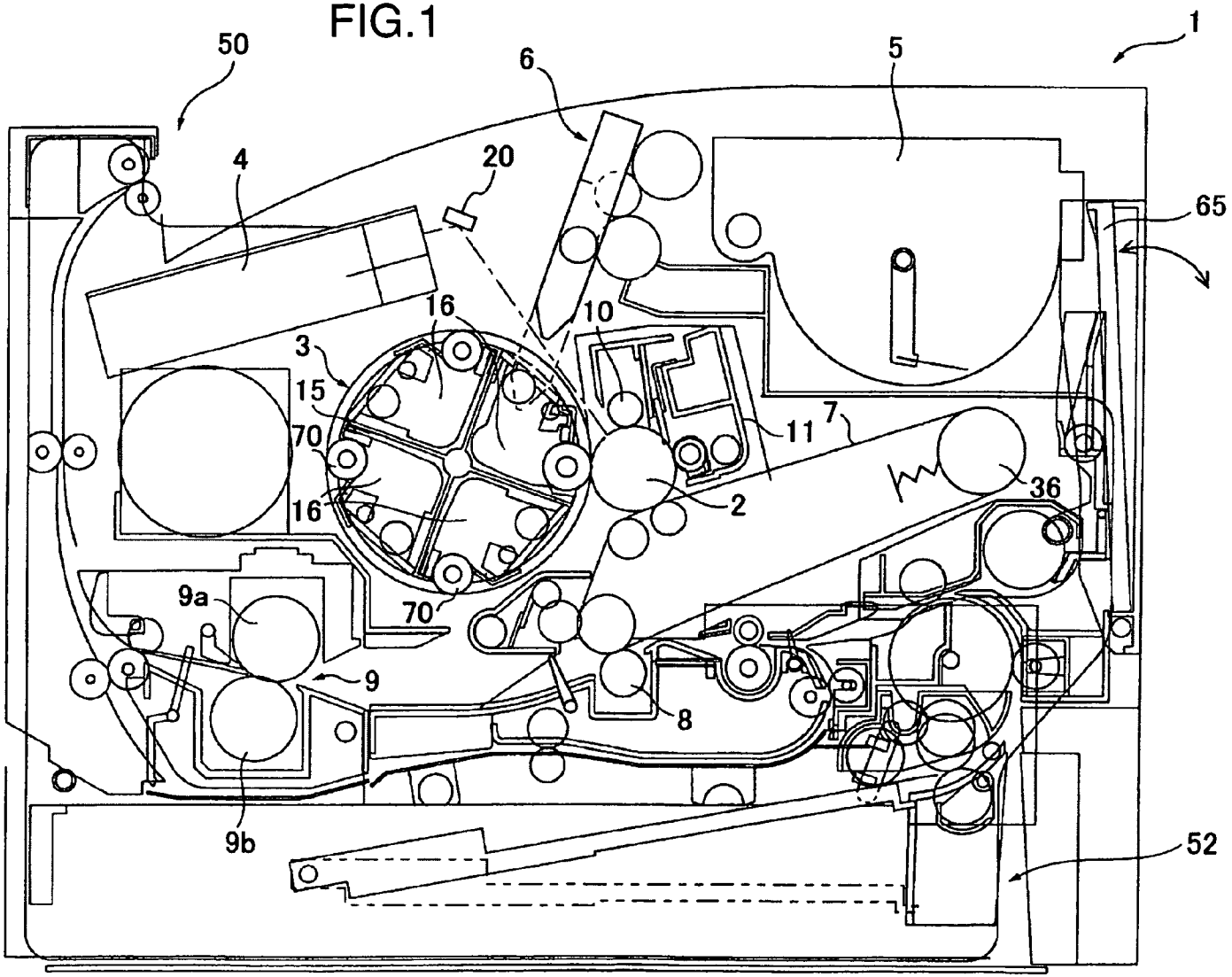
FIG. 1 is a schematic sectional view of a color printer according to an embodiment of the present invention.

FIG. 1 is a schematic sectional view of a color printer 1 according to an embodiment of the present invention. Herein, FIG. 1 schematically represents an arrangement of components, details of each component being omitted.

This color printer 1 is connected to a computer (not shown) or the like, and performs a printing of a color image on a sheet in accordance with image information sent from the computer. The color printer 1 includes a photoconductive drum 2, a rotary developing unit 3, a laser unit 4, a toner storage unit 5, a plurality of toner supply units 6, an intermediate transfer belt 7, a secondary transfer roller 8 and a fixing unit 9.

An electrostatic latent image is formed on a surface of the photoconductive drum 2 which is rotatably disposed substantially in a middle of the apparatus. A rotational axis of the photoconductive drum 2 extends perpendicularly to the paper surface of FIG. 1. Above the photoconductive drum 2, a charging roller 10 is provided which uniformly charges the surface of the photoconductive drum 2. On a side of the photoconductive drum 2, a drum cleaning unit 11 is provided to remove toner particles remaining on the surface of the photoconductive drum 2 or something cling to it.

The rotary developing unit 3 performs development of an electrostatic latent image formed on the photoconductive drum 2, using each colored toner. The rotary developing unit 3 is arranged adjacent to the photoconductive drum 2, and its center is substantially at the same vertical level as the axis of the photoconductive drum 2. This rotary developing unit 3 includes a rotating frame 15, and four developing devices 16 which correspond to four kinds of color toner and is supported to the rotating frame 15. The rotating frame 15 has a cylindrical shape and can rotate about its axis parallel to the rotational axis of the photoconductive drum 2. It is rotated by a driving mechanism including a motor or a gear (not shown). Besides, the rotating frame 15 is divided into quarters in a circumferential direction by partition members radially arranged to the rotational axis to thereby have four compartments. In each compartment, the developing device 16 is provided which corresponds to one of the four toner colors of yellow, cyan, magenta and black. This developing device 16 will be described later.

The laser unit 4 scans and exposes the photoconductive drum 2 on the basis of image information sent from an external computer or the like. The laser unit 4 is disposed above the photoconductive drum 2 and on a left side of the rotational axis of the rotary developing unit 3 in FIG. 1. The laser unit 4 has an internal configuration identical to the conventional one. The laser unit 4 includes a laser-beam source, a polygon mirror, a polygon-mirror driving motor, and the like. Ahead of the laser unit 4, a reflecting mirror 20 is provided on its laser optical path. Thereby, as shown by the one-pointed chain line of FIG. 1, a laser beam emitted from the laser unit 4 is bent by this reflecting mirror 20 to pass above the right side of the rotary developing unit 3 in FIG. 1 and irradiates the surface of the photoconductive drum 2.

The toner storage unit 5 is a portion which stores toner particles to be supplied to each developing device 16 of the rotary developing unit 3. The toner storage unit 5 is disposed above the photoconductive drum 2 and on the opposite side (i.e., on the right side of FIG. 1) to the laser unit 4. This toner storage unit 5 has four storage sections which are arranged laterally (i.e., in the direction perpendicular to the paper surface of FIG. 1). Those sections store each colored toner of yellow, cyan, magenta and black. Besides, the toner storage unit 5 can be withdrawn to rightward of FIG. 1.

The toner supply unit 6 is used for supplying each colored toner stored in the toner storage unit 5 to their corresponding developing device 16, and is disposed above the photoconductive drum 2 and between the laser unit 4 and the toner storage unit 5. The toner supply unit 6 includes four toner supply pipes which are moveable up and down, four conveyance pipes which connect the four color toner storing sections of the toner storage unit 5 to the corresponding toner supply pipes, and a driving mechanism for moving each toner supply pipe up and down.

The intermediate transfer belt 7 is adapted for transferring one after another four color toner images which are formed on the photoconductive drum 2, and is disposed below the photoconductive drum 2 and the toner storage unit 5. The secondary transfer roller 8 is adapted for transferring a toner image transferred on the intermediate transfer belt 7 onto a sheet which is forwarded, and is disposed below a lowest roller of a plurality of rollers on the intermediate transfer belt 7. The secondary transfer roller 8 is placed to face this roller.

The fixing unit 9 is for melting and fixing toner particles transferred on a sheet, and is disposed below the rotary developing unit 3 and on the left side of FIG. 1. This fixing unit 9 includes a heating roller 9*a* which has a heater built-in, and a pressure roller 9*b* which comes into contact with and presses the heating roller 9*a* to thereby sandwich a sheet between both rollers and forward it.

On a top of this printer 1, a discharge portion 50 is formed for receiving an image-fixed sheet. In addition, On a bottom of the apparatus, a sheet supply cassette 52 is provided. Below the toner storage unit 5 and above the sheet supply cassette 52, a sheet supply tray 65 is disposed so as to form a side wall as shown in the right side of FIG. 1. This sheet supply tray 65 is pivotal at a lower end thereof, and enables its upper end to fall toward the right side of FIG. 1 (i.e., freely opened and closed). In this way, the sheet supply tray 65 is opened, and in this state, a sheet is placed on the sheet supply tray 65 to thereby supply a sheet into the apparatus.

2. Developing Device

Figure 2:
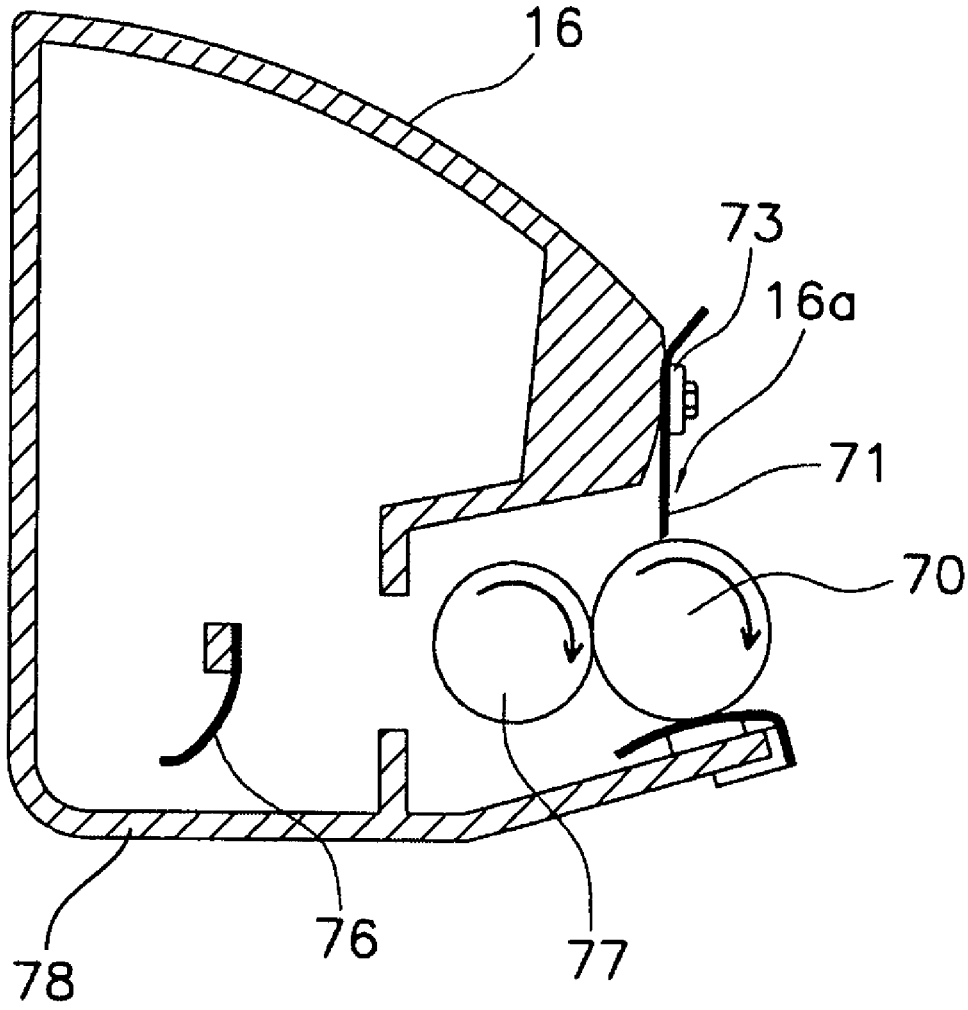
FIG. 2 is a side sectional view of container housing.
Figure 3:
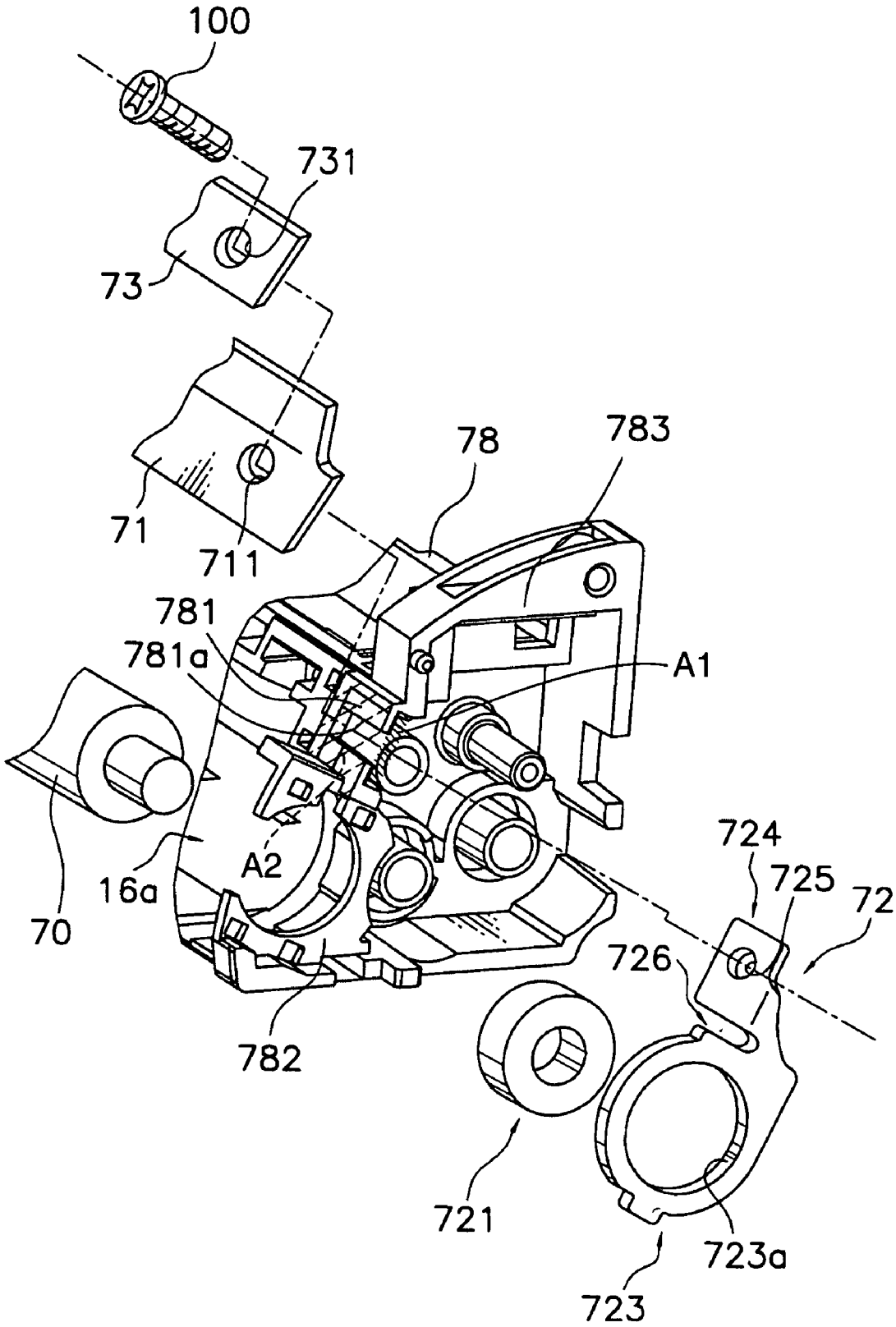
FIG. 3 is an exploded perspective view of an end part of the container housing.
Figure 4:
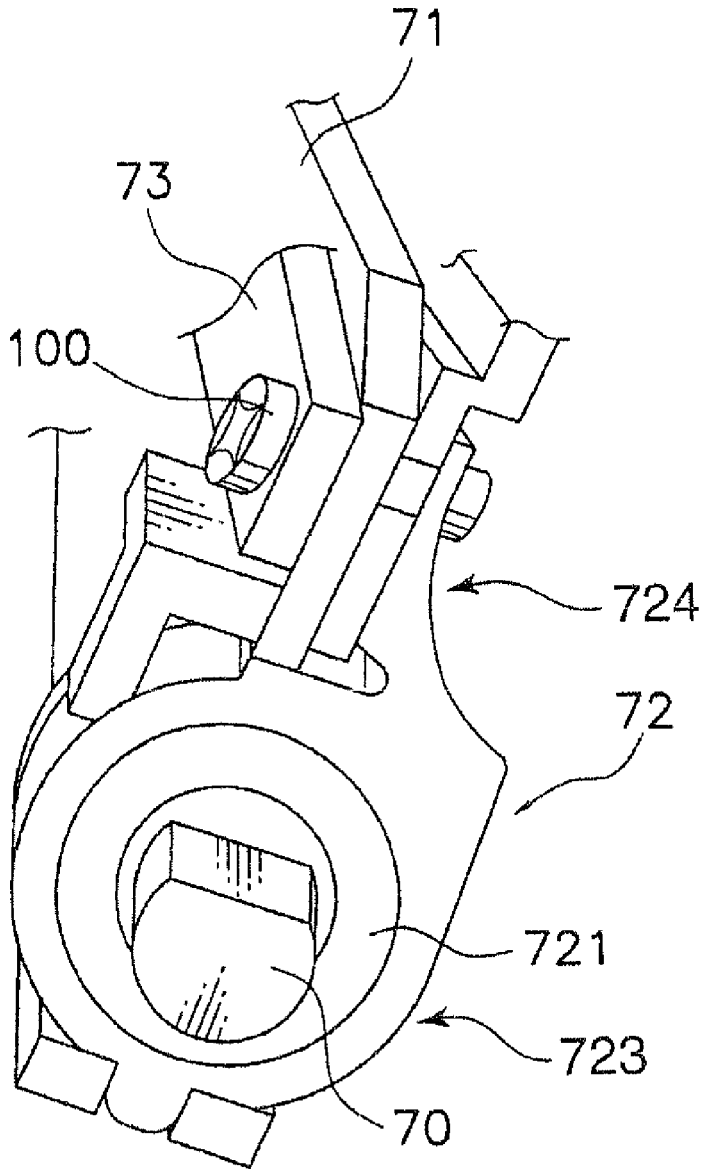
FIG. 4 is a perspective view of a developing roller and a regulating member when they are attached to the container housing.

The four developing devices 16 have almost the same configuration. As shown in FIG. 2 which is a sectional view of the developing device 16, the developing device 16 includes a developing roller 70, a container housing 78 (i.e., a support member) which has an opening 16*a* along an axial direction of the developing roller 70, a regulating member 71, a holding member 72 (refer to FIG. 3 and FIG. 4) for holding the developing roller 70 and the regulating member 71, and a reinforcement plate 73 (refer to FIG. 3 and FIG. 4). Herein, FIG. 3 is an exploded perspective view of an end part of the container housing 78. FIG. 4 shows that the developing roller 70 and the regulating member 71 are kept attached to the container housing 78.

The developing roller 70 is adapted for supplying toner particles (i.e., developer) to the photoconductive drum 2, and has a cylindrical column shape. This developing roller 70 is rotatably disposed and a part thereof is exposed from the opening 16*a*. For the developing device 16 for black, a magnetic development method is adopted. Hence, the developing roller 70 of the black developing device 16 includes an internal magnet, and a developing sleeve which is provided around the magnet and rotates around the magnet. Toner particles are attracted by the magnet, and as the developing sleeve rotates, they are carried to the position opposite to the photoconductive drum 2.

The container housing 78 has a chamber for storing toner particles and is provided inside with a toner stirring member 76 and a toner supply roller 77. As shown in FIG. 3, a mount portion 781 is formed on each of longitudinally side walls 783 of the container housing 78 or axially both ends of the container housing 78. The mount portion 781 protrudes out laterally (i.e., outward at axially both ends of the developing roller 70). A developing roller mount portion 782 has a substantially C-shape so as to support the developing roller 70. In the mount portion 781, an attachment recess 781*a* is formed. An outward end of the recess is opened.

The regulating member 71 is adapted for regulating toner particles on the developing roller 70 into a uniform layer, and is disposed along an axial direction of the developing roller 70. In addition, the regulating member 71 is made of a magnetic metal and is bent into a V-shape which is stronger than a flat shape. The regulating member 71 is disposed in the opening 16*a* of the container housing 78 so that its leading end faces the developing roller 70. The regulating member 71 is formed with attachment holes 711 on both ends thereof.

The holding member 72 is, as shown in FIG. 3, a member for holding the respective ends of the developing roller 70 and the regulating member 71 onto the container housing 78. The holding member 72 is disposed on both ends of the developing roller 70 and the regulating member 71. The holding member 72 includes a developing roller support portion 723 which corresponds to the axially end part of the developing roller 70 and has a shape of a ring having a hole 723*a* at the center, and a regulating member retaining portion 724 for holding the regulating member 71 to the container housing 78 to keep the distance between the regulating member 71 and the developing roller 70 uniform. Herein, FIG. 3 shows the end part of the container housing 78, the regulating member 71, and the developing roller 70 as well as the holding member 72.

In the developing roller support portion 723, a bearing 721 (e.g., a roll bearing) is fitted into the hole 723*a*. This bearing 721 has a shape of a ring having a hole into which the rotational shaft of the developing roller 70 is inserted. It is thicker than the developing roller support portion 723. Hence, when the bearing 721 is inserted into the developing roller support portion 723, a part of the bearing 721 juts out from the developing roller support portion 723. This part of the bearing 721 which juts out from the developing roller support portion 723 is inserted into and supported on the developing roller mount portion 782 of the container housing 78. Consequently, the developing roller 70 is supported on the container housing 78.

In a peripheral part of the developing roller support portion 723 is formed a straight regulating member contact portion 726. The end part of the regulating member 71 comes into contact with this regulating member contact portion 726, so that the distance between the developing roller 70 and the regulating member 71 is regulated to be a predetermined distance.

The regulating member retaining portion 724 is formed by a bending processing, and extends in a direction perpendicular to the developing roller support portion 723, and parallel to the regulating member contact portion 726 when attached to the container housing 78. A retaining portion attachment hole 725 is slightly smaller than the attachment hole 711 of the regulating member 71. The retaining portion attachment hole 725 is formed by a burring processing, and formed with a thread in an inner surface thereof.

The reinforcement plate 73 (refer to FIG. 3) extends in the same direction as the regulating member 71, and has a strip shape, and is adapted for reinforcing the regulating member 71. Besides, the reinforcement plate 73 has an attachment hole 731 in a position corresponding to the attachment hole 711 of the regulating member 71, and is disposed so as to come into contact with the opposite surface of the regulating member 71 to the container housing 78.

3. Attachment of the Regulating Member 71 and the Developing Roller 70

Herein, a description will be given about how to attach the regulating member 71 and the developing roller 70 to the container housing 78.

In the process of attaching the regulating member 71 and the developing roller 70 to the container housing 78, first, the bearing 721 is placed on both ends of the developing roller 70. A part of the bearing 721 is inserted into the developing roller support portion 723. Then, the regulating member retaining portion 724 is attached to the mount portion 781. Specifically, the regulating member retaining portion 724 is brought into contact with an inside surface (i.e., a surface facing the rotational-center of the rotary developing unit 3) of the mount portion 781 so that the retaining portion attachment hole 725 can be seen from the attachment recess 781*a*. Then, the regulating member retaining portion 724 is placed in a solid-line hatched portion A1 of FIG. 3.

Then, the surface of the regulating member 71 is brought into contact with the outer surface of the mount portion 781 (i.e., the surface facing the periphery of the rotary developing unit 3 or a dotted-line hatched portion A2 of FIG. 3) in a state that the attachment hole 711 of the regulating member 71 agrees with the retaining portion attachment hole 725. At this time, the leading end of the regulating member 71 is brought into contact with the regulating member contact portion 726 of the developing roller support portion 723. Next, the reinforcement plate 73 is brought into contact with the regulating member 71. A bolt (i.e., fastener) 100 is inserted through the attachment hole 731 of the reinforcement plate 73 and the attachment hole 711 of the regulating member 71 from the left side of FIG. 4 to thereby engage with the threaded inner surface of the retaining portion attachment hole 725.

4. Operation

Next, an image forming operation will be described. First, the power source of the color printer is turned on, and various parameters are initialized, such as setting the temperature of the fixing unit 9. Then, image data is sent from the computer or the like connected to this printer. If an instruction is given to start printing, the image forming operation is executed in the following way.

First, the photoconductive drum 2 is charged by the charging roller 10. Thereafter, the photoconductive drum 2 is scanned and exposed in accordance with the image data by the laser unit 4, so that an electrostatic latent image is formed on the photoconductive drum 2. Next, the rotary developing unit 3 is rotated, and the developing device 16 having the corresponding color faces the photoconductive drum 2. At this time, inside of the developing device 16, toner particles are supplied via the toner supply roller 77 to the developing roller 70. As the developing roller 70 rotates, the thickness of a toner layer is regulated by the regulating member 71. Thus, toner particles are supplied to the photoconductive drum 2 from the toner layer on the developing roller 70.

In this configuration, there are between the regulating member 71 and the developing roller 70 only two tolerances, that is, a tolerance between the developing roller 70 and the holding member 72 and a tolerance between the regulating member 71 and the holding member 72. This makes it possible to arrange the regulating member 71 more precisely with respect to the developing roller 70.

Furthermore, the regulating member 71 is attached to the container housing 78 and the holding member 72 supporting the developing roller 70 is supported on the container housing 78. Therefore, the regulating member 71 and the developing roller 70 can be more accurately positioned with respect to the container housing 78. The developing roller 70 is positioned by the developing roller mount portion 782 and the regulating member 71 is positioned by the mount portion 781. This helps keep the developing roller 70 and the regulating member 71 in parallel, compared with the case where they are attached to the holding member 72. In other words, the regulating member 71 can be kept from being twisted with respect to the developing roller 70, or their respective axes are prevented from deviating from each other.

Moreover, the developing roller 70 is supported on the developing roller support portion 723 of the holding member 72, and the regulating member 71 is brought into contact with the regulating member contact portion 726. In this state, the distance between the developing roller 70 and the regulating member 71, or the gap between them, is determined. Then, the holding member 72 is attached on the mount portion 781. Therefore, the holding member 72 reinforces the supporting strength and keeps the gap constant. This makes it easy to unify the toner-layer thickness on the developing roller 70. In addition, one of the regulating member and the developing roller is provided with a magnet and the other is provided with a magnetic material or a magnet, as in the case where a magnetic development method is adopted or in other cases. In this configuration, they are allowed to attract to each other before fastening to thereby make a narrower distance or gap between them. This facilitates to realize a more precise distance. Furthermore, this configuration is advantageous to effectively prevent an irregular toner layer thickness, toner adhesion, and black spot on a developed image, which are the peculiar defects of the magnetic development method due to a change in the distance between the regulating member and the developing roller.

A developed image is transferred onto the intermediate transfer belt 7. This operation is repeated one by one for each color, so that a full color image is formed on the intermediate transfer belt 7. Residual toner particles or the like on the photoconductive drum 2 are removed by the drum cleaning unit 11. Then, they are discarded into a removed toner container.

On the other hand, a sheet is picked from the sheet supply cassette 52 by a forwarding roller or the like. This sheet is conveyed in timing with the image formation on the intermediate transfer belt 7. Then, it is guided to the secondary transfer roller 8. The secondary transfer roller 8 comes into contact with the intermediate transfer belt 7, and using a transfer bias applied to the secondary transfer roller 8, the full color image formed on the intermediate transfer belt 7 is transferred onto the sheet. This sheet is conveyed through a conveyance path to the fixing unit 9 and is heated and pressed in the fixing unit 9. Thereby, the image is fixed on the sheet, and it is discharged to the discharge portion 50.

Modification:

In the foregoing embodiment, the image forming apparatus in which toner particles are supplied from outside of the developing device is described as an example. However, the present invention may also be applied to an image forming apparatus in which toner particles are not supplied from the outside of the developing device but stored in the developing device.

It can be seen that the above described embodiment mainly include the inventions which has the following configurations.

A developing device comprises: a container housing which has an opening in a position opposite to an electrostatic latent image bearing body and stores developer to be supplied to the electrostatic latent image bearing body; a developing roller which is rotatably disposed and a part of which is exposed from the opening; a regulating member which is disposed along an axial direction of the developing roller and whose leading end is in a position of facing the developing roller, and regulates the thickness of a developer layer on the developing roller; and a pair of holding members which hold the developing roller and the regulating member on the container housing, each holding member including a developing roller support portion for supporting an end part of the developing roller and a regulating member retaining portion for retaining the regulating member to the container housing.

Also, an image forming apparatus comprises: an electrostatic latent image bearing body; and a developing device which supplies developer to the electrostatic latent image bearing body. The developing device includes the above described configuration.

In this developing device, developer (i.e., toner particles) stored in the container housing adheres to the developing roller. With the toner particles adhering to the developing roller, the developing roller rotates, so that the thickness of a toner layer is regulated between the developing roller and the regulating member. At this time, the developing roller and the regulating member are held by the pair of holding members. Therefore, a tolerance between the regulating member and the developing roller includes only two tolerances, that is, a tolerance between the regulating member and the holding member and a tolerance between the developing roller and the holding member. Therefore, the positioning precision becomes higher between the developing roller and the regulating member. Hence, this high positioning accuracy between the developing roller and the regulating member enhances easy unification of the toner-layer thickness on the developing roller.

Further, it may be preferable that a fastener is further provided, and the container housing includes a mount portion on each of axially both ends thereof, and the regulating member is disposed on an outside of each mount portion of the container housing, and the regulating member retaining portion of each holding member is disposed on an inside of the mount portion opposite to the regulating member, and the fastener fastens the regulating member, the mount portion and the regulating member retaining portion with one another.

According to this configuration, the developing roller is supported on the developing roller support portion of the container housing, and the regulating member is positioned by the mount portion. Therefore, the developing roller and the regulating member can be precisely positioned. Besides, the regulating member is attached to the mount portion. This is advantageous in reinforcing the supporting strength.

Furthermore, it may be preferable to further provide a bearing for supporting the developing roller rotatably. In this case, the developing roller support portion has a shape of a ring having a hole at the center and the bearing be attached to the hole.

In the above described configuration, it may be preferable that the container housing stores a magnetic single component developer. In the developing device where the magnetic single component developer is used, in general, a magnetic roller is frequently used as the developing roller. In this case, the regulating member is magnetized. If the distance between the developing roller and the regulating member is changed, a defect on an image, such as a black spot or an uneven layer, is likely to occur. However, the above-described configuration is especially effective for this problem.

In the above described configuration, it may be preferable that the pair of holding members each include a regulating member contact portion which is formed on an outer periphery of the developing roller support portion and comes into contact with the leading end of the regulating member so as to regulate the distance between the developing roller and the regulating member. According to this configuration, the regulating member can be precisely positioned with respect to the developing roller.

In the above described configuration, it may be preferable that the developing roller and the regulating member are provided with a magnet, or one of the developing roller and the regulating member is provided with a magnet, and the other is provided with a magnetic member. According to this configuration, before those members are fastened, a magnetic force keeps the distance between them constant. This makes it possible to enhance the positioning precision further.

Another developing device comprises: a support member; a developing roller which be rotatable to supply developer; a regulating member which is disposed at a predetermined distance against the peripheral surface of the developing roller and regulates the thickness of a developer layer on the developing roller; and a holding member which is fixedly attached to the support member, and includes a developing roller support portion for supporting an end part of the developing roller and a regulating member retaining portion for retaining the regulating member.

As describe so far, the developing device and the image forming apparatus can provide a precise positioning of the regulating member with respect to the developing roller.

This application is based on patent application No. 2006-126630 filed in Japan, the contents of which are hereby incorporated by references.

As has been described, according to the invention, it is possible for an apparatus that transports toner particles laterally and longitudinally to deliver the toner particles in a satisfactory manner at transition between lateral transportation and longitudinal transportation, which can in turn prevent built-up of toner particles.

What is claimed is:

1. A developing device which supplies developer to an electrostatic latent image bearing body of an image forming apparatus, comprising:

a container housing which has an opening in a position opposite to the electrostatic latent image bearing body and stores developer to be supplied to the electrostatic latent image bearing body;

a developing roller which is rotatably disposed and a part of which is exposed from the opening;

a regulating member which is disposed along an axial direction of the developing roller and whose leading end is in a position of facing the developing roller so as to regulate the thickness of a developer layer on the developing roller; and a pair of holding members which hold the developing roller and the regulating member on the container housing, each holding member including a developing roller support portion for supporting an end of the developing roller and a regulating member retaining portion for retaining the regulating member onto the container housing, wherein the pair of holding members each include a regulating member contact portion which is formed on an outer periphery of the developing roller support portion and comes into contact with the leading end of the regulating member so as to regulate the distance between the developing roller and the regulating member.

2. The developing device according to claim 1, further comprising a fastener, wherein:

the container housing includes a mount portion for each of axially both ends of the developing roller;

the regulating member is disposed on an outside of the mount portion of the container housing;

the regulating member retaining portion of the holding member is disposed on the inside of the mount portion opposite to the regulating member; and the fastener fastens the regulating member, the mount portion and the regulating member retaining portion with one another.

3. The developing device according to claim 1, further comprising a bearing which rotatably supports the developing roller, wherein:

the developing roller support portion has a shape of a ring having a hole at the center; and the bearing is attached to the hole.

4. The developing device according to claim 1, wherein the container housing stores a magnetic single component developer.

5. The developing device according to claim 1, wherein the developing roller and the regulating member are provided with magnets, respectively.

6. The developing device according to claim 1, wherein one of the developing roller and the regulating member is provided with a magnet, and the other is provided with a magnetic member.

7. A developing device, comprising:

a support member;

a developing roller which rotates freely and supplies developer;

a regulating member which is disposed at a predetermined gap to a peripheral surface of the developing roller, and regulates the thickness of a developer layer on the developing roller; and a holding member which is fixedly attached to the support member, and includes a developing roller support portion for supporting an end part of the developing roller and a regulating member retaining portion for retaining the regulating member, wherein the holding member includes a regulating member contact portion which is formed on an outer periphery of the developing roller support portion and comes into contact with the leading end of the regulating member so as to regulate the distance between the developing roller and the regulating member.

8. The developing device according to claim 7, further comprising a bearing which rotatably supports the developing roller, wherein:

the developing roller support portion has a shape of a ring having a hole at the center; and the bearing is attached to the hole.

9. The developing device according to claim 7, wherein the developing roller and the regulating member are provided with magnet, respectively.

10. The developing device according to claim 7, wherein one of the developing roller and the regulating member is provided with a magnet, and the other is provided with a magnetic member.

11. An image forming apparatus, comprising:

an electrostatic latent image bearing body; and a developing device which supplies developer to the electrostatic latent image bearing body, the developing device includes:

a container housing which has an opening in a position opposite to the electrostatic latent image bearing body and stores developer to be supplied to the electrostatic latent image bearing body;

a developing roller which is rotatably disposed and a part of which is exposed from the opening;

a regulating member which is disposed along an axial direction of the developing roller and whose leading end is in a position of facing the developing roller, and regulates the thickness of a developer layer on the developing roller; and a pair of holding members which hold the developing roller and the regulating member on the container housing, each holding member including a developing roller support portion for supporting an end part of the developing roller and a regulating member retaining portion for retaining the regulating member onto the container housing, wherein the pair of holding members each include a regulating member contact portion which is formed on an outer periphery of the developing roller support portion and comes into contact with the leading end of the regulating member so as to regulate the distance between the developing roller and the regulating member.

12. The image forming apparatus according to claim 11, further comprising a fastener, wherein:

the container housing includes a mount portion for each of axially both ends of the developing roller;

the regulating member is disposed on an outside of the mount portion of the container housing;

the regulating member retaining portion of the holding member is disposed on an inside of the mount portion and in opposite to the regulating member; and the fastener fastens the regulating member, the mount portion and the regulating member retaining portion with one another.

13. The image forming apparatus according to claim 11, further comprising a bearing which rotatably supports the developing roller, wherein:

the developing roller support portion has a shape of a ring having a hole at the center; and the bearing is attached to the hole.

14. The image forming apparatus according to claim 11, wherein the container housing stores a magnetic single component developer.

15. The image forming apparatus according to claim 11, wherein the developing roller and the regulating member are provided with magnets, respectively.

16. The image forming apparatus according to claim 11, wherein one of the developing roller and the regulating member is provided with a magnet, and the other is provided with a magnetic member.

* * * * *